United States Patent [19]

Kaitatzidis

[11] 4,010,547

[45] Mar. 8, 1977

[54] DRAFTING MACHINE

[76] Inventor: Michael Kaitatzidis, 34 Weiherstrasse, D-7775 Bermatingen, Germany

[22] Filed: Dec. 23, 1974

[21] Appl. No.: 536,021

[30] Foreign Application Priority Data

May 14, 1974 Germany ..... 2423306

[52] U.S. Cl. ..... 33/80

[51] Int. Cl.[2] ..... B43L 13/04

[58] Field of Search ..... 33/80, 1 K, 77, 277, 33/76, 103, 94, 102, 101

[56] References Cited

UNITED STATES PATENTS

| | | | |
|---|---|---|---|
| 970,625 | 9/1910 | Krajicek | 33/94 |
| 1,882,354 | 10/1932 | Celenza | 33/117 |
| 3,102,340 | 9/1963 | Rackleff | 33/102 |

FOREIGN PATENTS OR APPLICATIONS

| | | | |
|---|---|---|---|
| 761,214 | 1/1934 | France | 33/80 |
| 519,909 | 4/1940 | United Kingdom | 33/77 |

*Primary Examiner*—Harry N. Haroian
*Attorney, Agent, or Firm*—Watson, Cole, Grindle & Watson

[57] ABSTRACT

A drafting machine is provided including a drafting frame, a continuous guide groove on the surface of the frame along each side thereof, spaced slide elements disposed in the groove and at least one drawing instrument pivotally connected to the slide element. Alternatively, a single slide element may be disposed in the groove with spaced bearing elements in engagement with an outer wall of the groove. The slide element or elements are connected to the drawing instrument through an elongated slot thereof so that the drawing instrument may be displaced longitudinally of and transversely to the guide groove.

13 Claims, 21 Drawing Figures

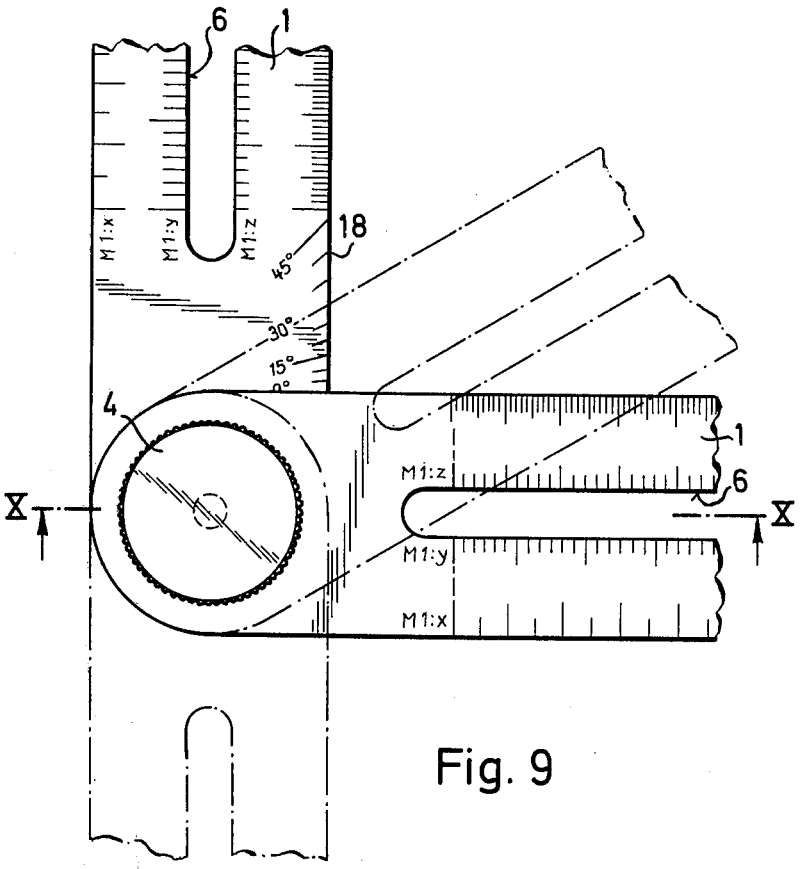
Fig. 9
Fig. 10
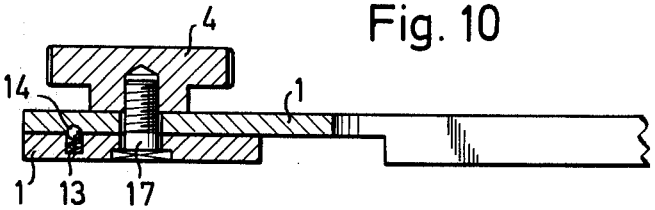

6
1
19
2
19
12
18
6
2
1
4
5
19
19
3

Fig. 13
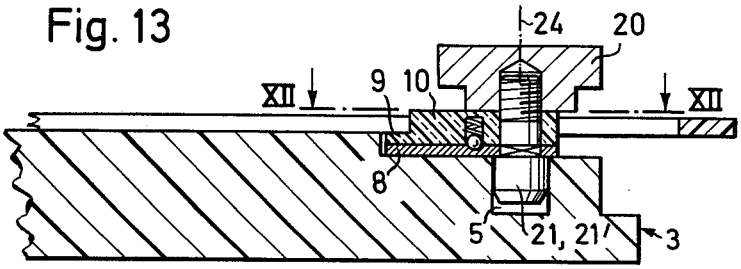
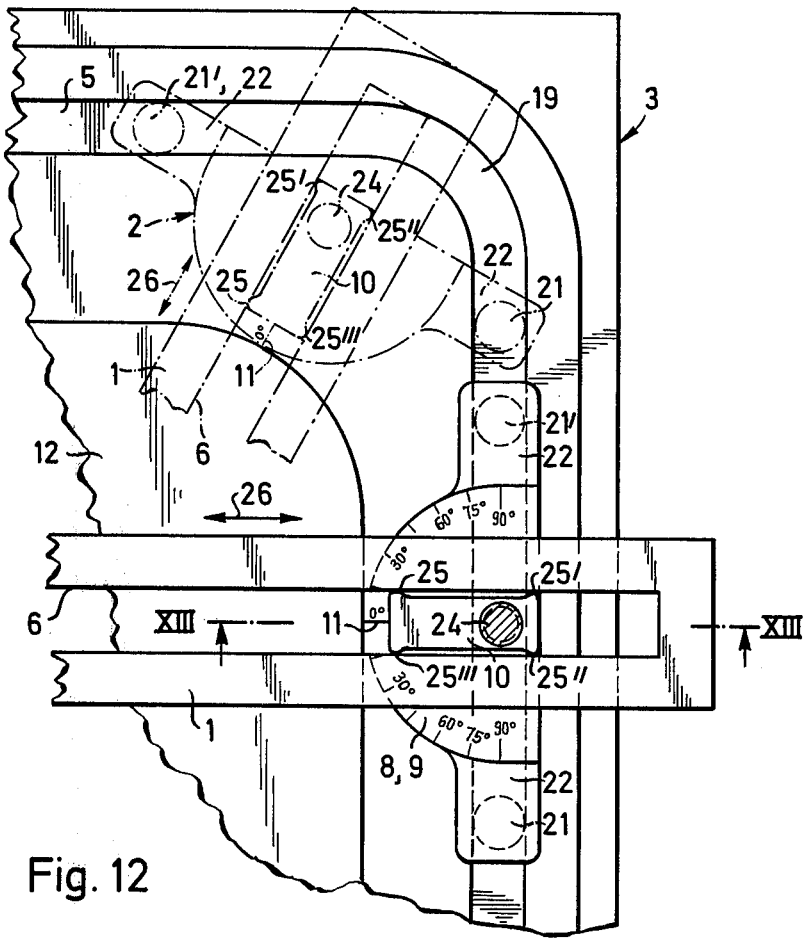
Fig. 12

Fig. 17
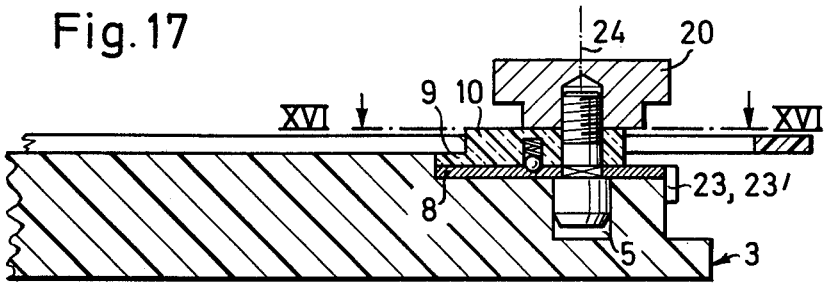
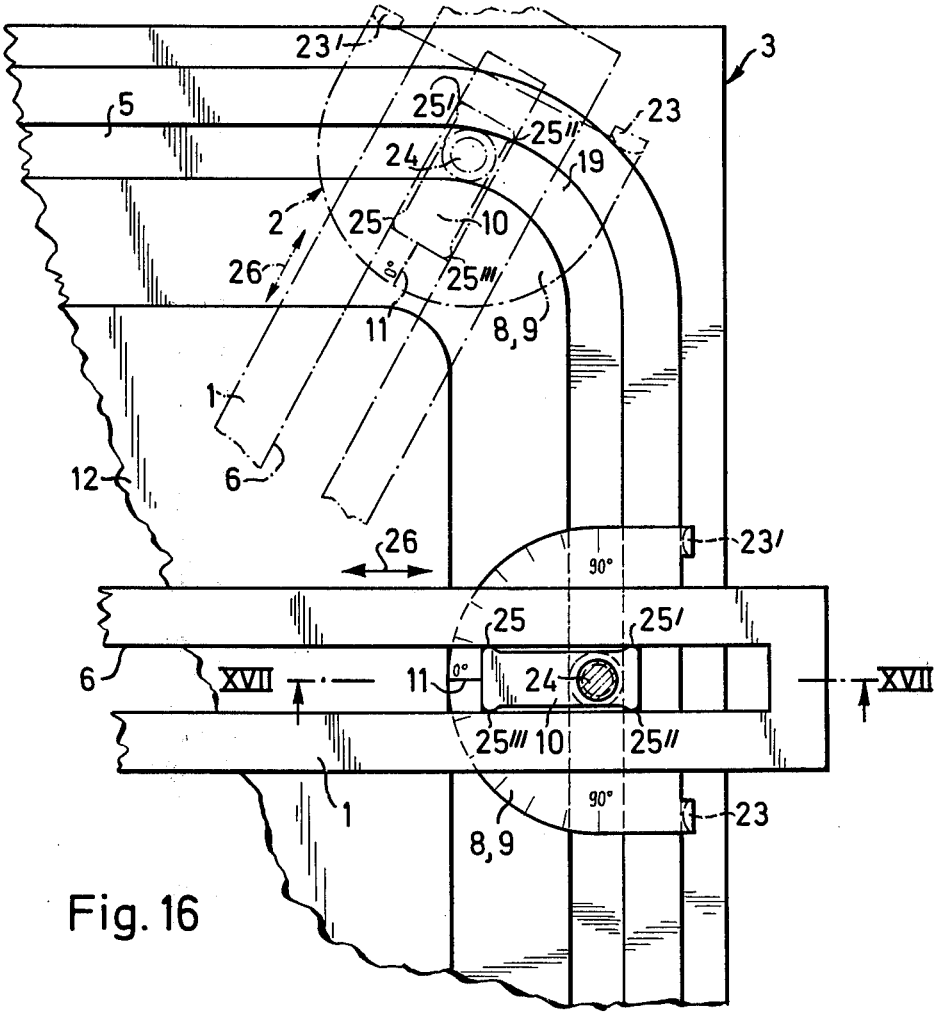
Fig. 16

Fig. 19
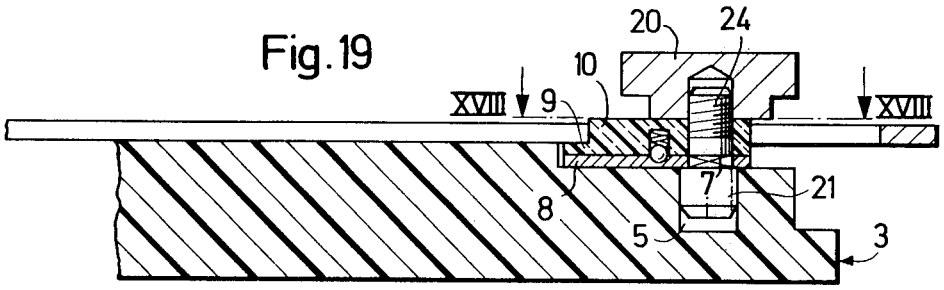
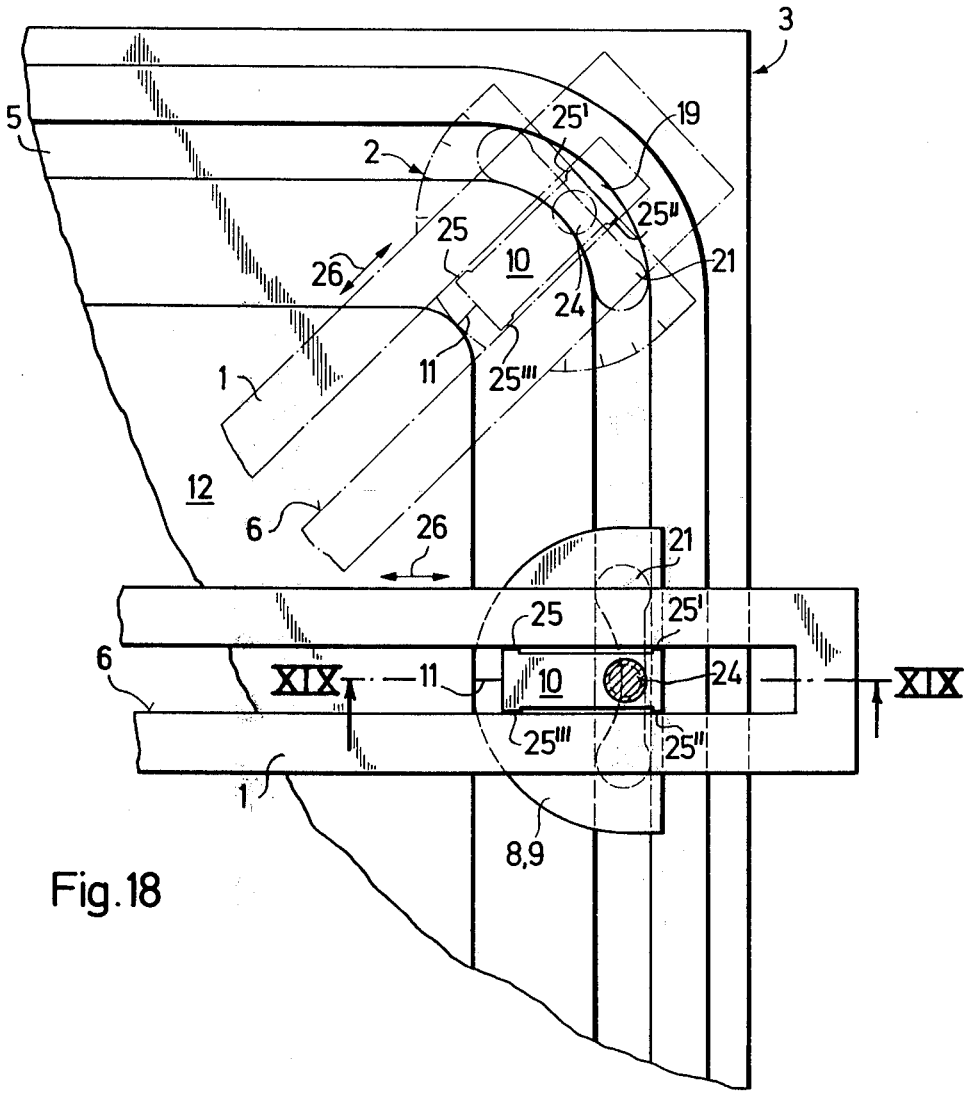
Fig. 18

DRAFTING MACHINE

This invention relates to a drafting machine, consisting of a drafting frame, one or more drawing instruments and a guide.

Drawing equipment, and especially drawing boards, are known, as having a groove provided on each drawing board, in which the instruments used for drawing are guided. This type of guide limits the possibilities of movement of the drawing instruments used and thus makes it impossible for the drawing instruments to reach the entire drawing surface in a continuous and infinitely adjustable manner. In order to enable the entire drawing surface to be covered using such drafting equipment, it is necessary to move and change the drawing instruments frequently. Furthermore, the four outer corners of the drawing board are either inaccessible or can only be reached with difficulty. Many drawing functions can only be carried out using auxilliary equipment, thus resulting in appreciable increase in the expense of the equipment.

It is therefore the objective of the present invention to provide a drafting machine which can reach every point of the drawing surface continuously and accurately, without it being necessary to continuously change or replace the drawing instruments for this purpose.

This objective is achieved by the invention in that the drawing instrument or a number of drawing instruments can revolve as desired and at the same time can be displaced by means of a slot around one or more slide elements, which in turn can be moved along a groove or appropriate abutment edge surrounding the drawing surface, the displacement movements of the instruments being lontitudinally or transversely of the groove.

The drafting machine according to the invention makes the use of auxilliary drawing instruments virtually unnecessary. The method of use is appreciably simplified and the cost of a complete drafting machine can be reduced.

The invention will be explained by means of examples of an embodiment with reference to drawings.

FIG. 9 is a plan view of parts of two drawing instruments pivotally connected to each other.

FIG. 10 is a section through the connection between the two drawing instruments taken substantially along X—X of FIG. 9.

FIG. 12 is a plan view of a further example of an embodiment of a slide element taken substantially along line XII—XII of FIG. 13.

FIG. 13 is a section through the arrangement of FIG. 12 taken substantially along line XIII—XIII thereof.

FIG. 16 is a plan view of a further example of an embodiment of a slide element taken substantially along line XVI—XVI of FIG. 17.

FIG. 17 is a partial section through the arrangement of FIG. 16 taken substantially along line XVII—XVII thereof.

FIG. 18 is a plan view of a further example of an embodiment of a slide element taken substantially along line XVIII—XVIII of FIG. 19.

FIG. 19 is a partial section through the arrangement of FIG. 18 taken substantially along line XIX—XIX of FIG. 18.

Figure 1:
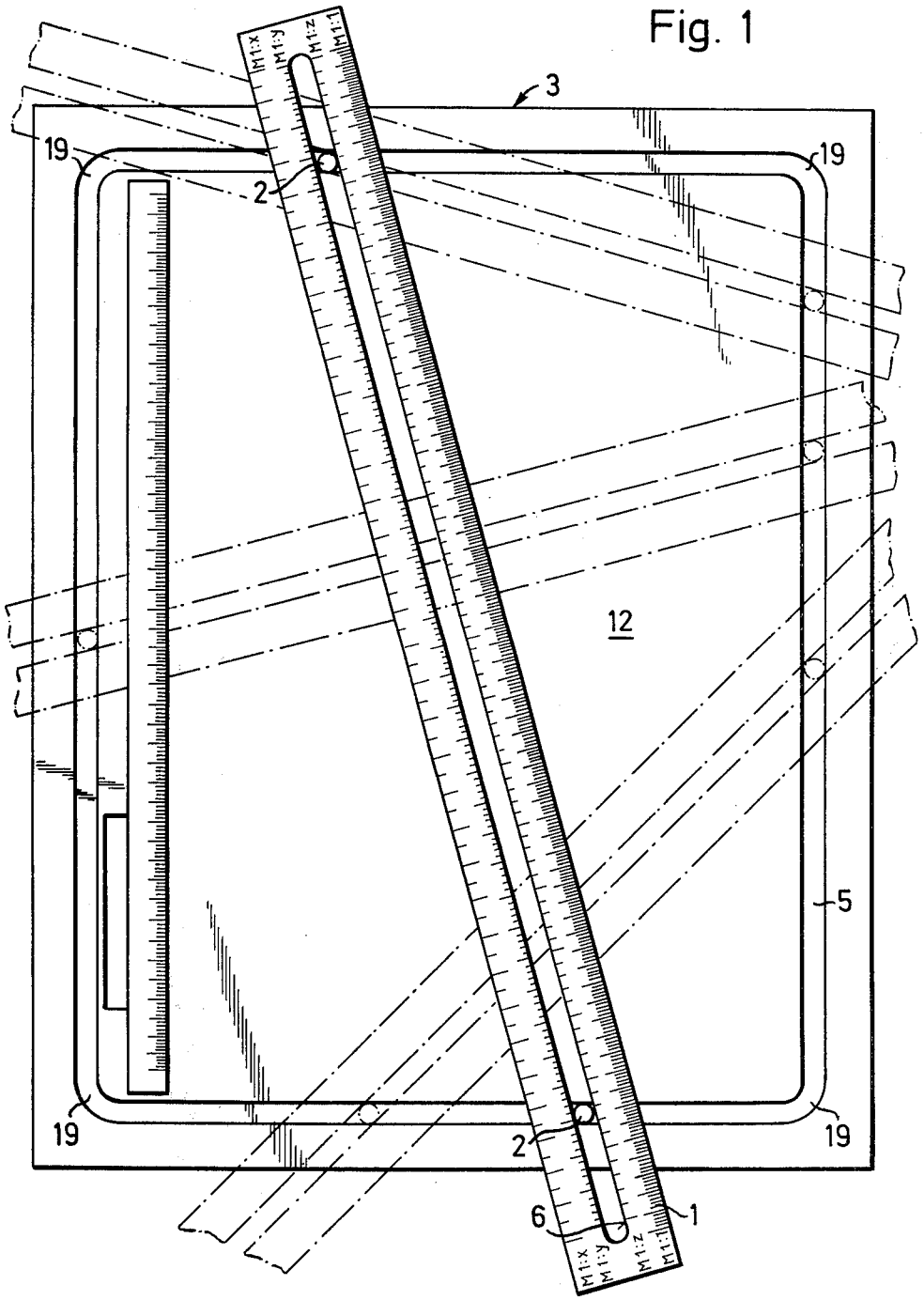
FIG. 1 is plan view of a drafting frame having a peripheral guide groove, with a drawing instrument, and two slide elements.

A closed groove 5 is provided on a drawing surface 12 of a drawing frame 3 (FIG. 1). The corner connections of the groove 5 are each rounded as at 19.

A slide element 2 in the form of a stud is disposed in groove 5, a flat element 2 having a plane surface for accurate guiding in the groove 5 (FIG. 4) and further having a domed surface enabling it to slide in the rounded corners 19. The slide element 2, which can be of plastic or metal, is guided with its other end in a slot 6 of a drawing instrument 1. This double guiding of slide element 2 makes it possible for the drawing instrument 1 to be moved into any desired position, because with this type of guidance the drawing instrument 1 can be moved along the groove 5 and transversely thereto while at the same time turning about the axis of slide element 2. Three other random positions of the drawing instrument, shown in phantom outline in FIG. 1, can be reached without changing the drawing instrument 1, because the slide element 2 ensures a continuous sliding in the peripheral groove 5. It is possible for the drawing instrument 1 to be moved to any position on the drawing surface 12, whether one or two slide elements (as shown in FIG. 1) are used.

Figure 2:
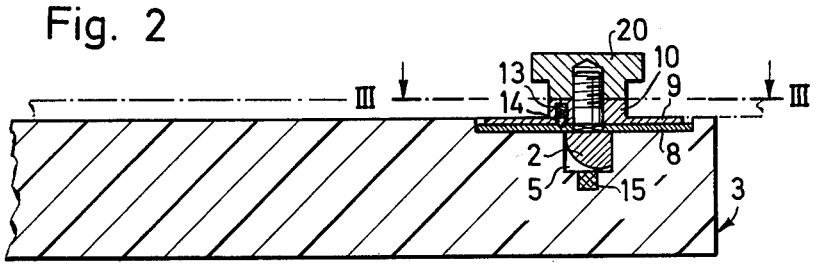
FIG. 2 is a section through a drafting frame and through a protractor and clamping device.
Figure 3:
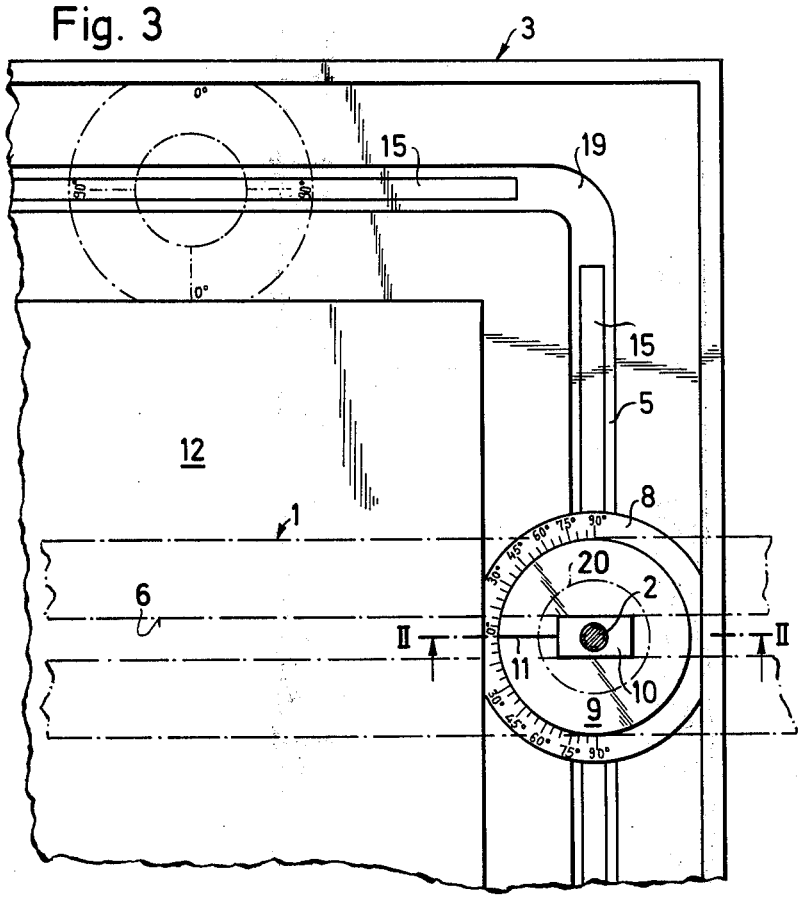
FIG. 3 is a plan view of part of a drafting frame taken substantially along line III—III of FIG. 2 and comprising a protractor and clamping device.
Figure 4:
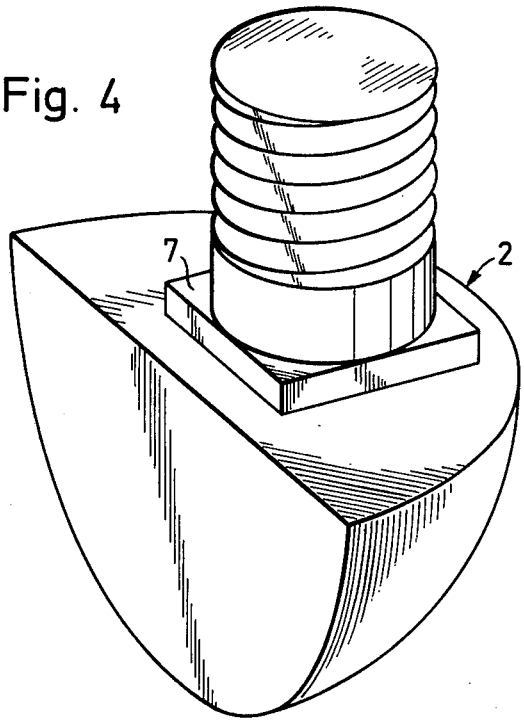
FIG. 4 is a perspective view of a slide element.
Figure 5:
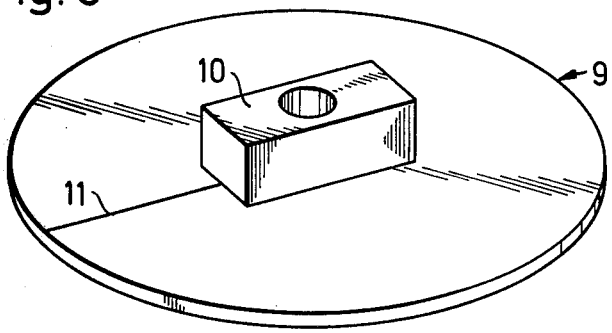
FIG. 5 is a perspective view of a disc comprising a stop and an indicator mark.

The sliding engagement of slide element 2 in the groove 5 of the drawing frame 3 is shown in detail in FIG. 2. As described above the perspective view of the slide element 2 in FIG. 4 shows that is has at its one end a flat plane surface and a domed surface. The plane surface ensures its exact guiding in the straight groove, while the domed surface makes it possible for it to slide around the curved portions 19 of groove 5. A protractor 8 (FIGS. 2, 3, 6, 7), marked in degrees (FIGS. 3, 7) is fixed on a four-sided projection 7 of the slide element 2. It is therefore possible for the protractor disc 8 to travel with the slide element 2 along the groove. The protractor 8 is also flattened on two sides for fittin within a depression in the drafting frame, so that it is additionally guided in this depression. Regardless of the momentary position of the slide element 2, the protractor 8 always retains the same position, for example with the 0° marking always perpendicular to the groove (FIGS. 3 and 7). A second disk 9, having a stop 10 at its center (FIG. 5) is mounted above protractor 8. A cylindrical hole is provided at the center of stop 10 so as to permit the disc to be rotated about the cylindrical portion of the slide element 2. The slot 6 of the drawing instrument 1 is guided along the longitudinal external surfaces of the stop 10. The disc 9 also has an indicator mark 11 which shows the angle set on the protractor 8. The setting of any desired angle using drawing instrument 1 is carried out as follows:

If the drawing instrument 1 is rotated about the slide element 2 as its axis, then the disc 9, entrained by the slot 6 of the drawing instrument 1, rotates by the same amount and shows by its indicator mark 11 on the protractor 8 the particular angle set.

If it is desired to continue working with this angle, then the drawing instrument 1 is clamped by means of a clamping wheel 20, so that the drawing instrument 1 cannot move transversely to the groove nor rotate about the slide element 2. With the drawing instrument 1 fixed in this way, parallel lines can be drawn, for example for cross hatching or the like, since the slide element 2 and with it the instrument 1 can still slide along the groove 5.

Figure 6:
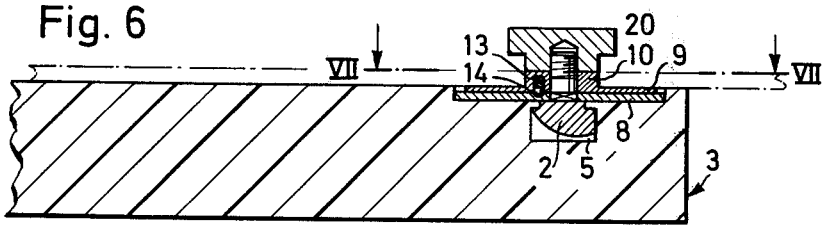
FIG. 6 is a section similar to FIG. 2 through a drafting frame, but with a different type of groove.
Figure 7:
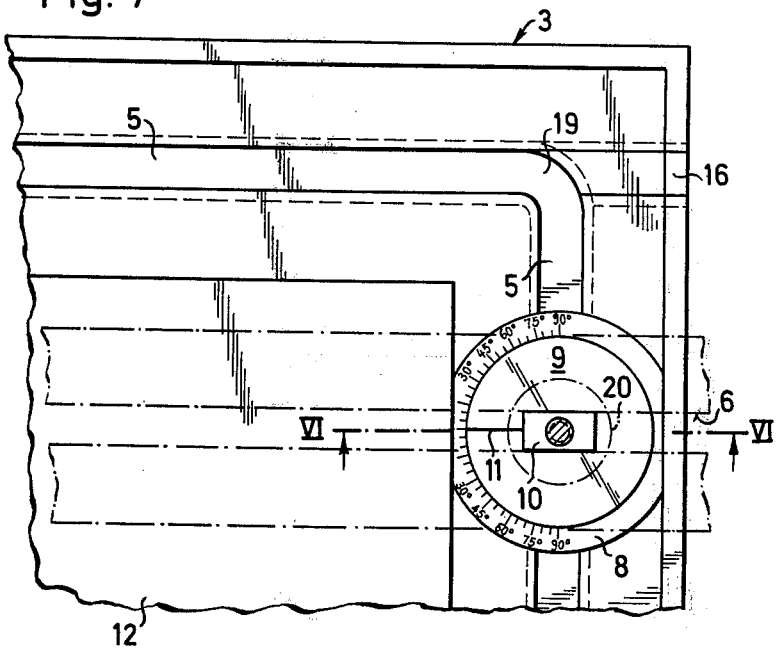
FIG. 7 is a plan view corresponding to FIG. 3.
Figure 8:
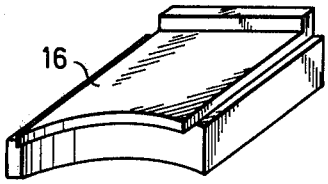
FIG. 8 is a perspective view of a closure piece.

For particular angle settings, e.g. 15°, 30°, 45°, 60°, 75° and 90°, an arrestor system, consisting of a compression spring 13 and a catch element 14, is provided in stop 10 of the disc 9 (FIGS. 2 and 6). The catch element 14 engages in a known manner with corresponding recesses disposed at angular spacings of 15° around the protractor 8.

In the arrangement shown, the drawing instrument 1 can be optionally removed, either together with the entire sliding and pivoting device or, after clamping wheel 20 has been unscrewed, can be removed alone from the drawing board 3.

In order to prevent disengagement between the slide element 2 and groove 5 during drawing, a magnetic rod 15 (FIGS. 2, 3) can be disposed within a further depression of the groove 5; this rod then attracts the metal slide element 2 and with it also the drawing instrument 1, and holds them firmly on the drawing frame 3.

Another embodiment of the invention is shown in FIG. 6. This differs from that already described by a different shape for the groove 5, and a corresponding shape of the slide element 2. The slide element 2, together with the protractor 8, and the disc 9 is in this embodiment permanently connected to the drafting frame 3. The drawing instrument 1 can be removed from the drafting frame 3 by simply unscrewing the clamping wheel 20.

This shape of the groove 5 renders the use of a magnetic rod unnecessary. For simplicity in manufacture, an opening having the profile of the groove 5 is formed in the drafting frame 3 at all four corners; this opening is closed by inserting a closure piece 16 therein (FIG. 7). A further development of the drawing instrument 1 is described with reference to FIGS. 9 and 10.

Instead of the single-component drawing instrument 1 according to FIG. 1, a pivotal connection is provided between two similar drawing instruments 1, which can thus adopt any desired angular setting relative to each other.

Each of the two instruments 1 to be joined together comprises a passage through which a threaded pin 17 is inserted. This threaded pin 17 has a four sided head, which is known manner fits into a corresponding recess in one of the drawing instruments 1, so that the threaded pin is prevented from turning when a clamping knob 4 is rotated.

When the two drawing instruments 1 have been unclamped by releasing the clamping knob 4, any desired angular setting of the two drawing instruments relative to each other can be achieved using an angle scale 18 marked on one drawing instrument 1.

Figure 11:
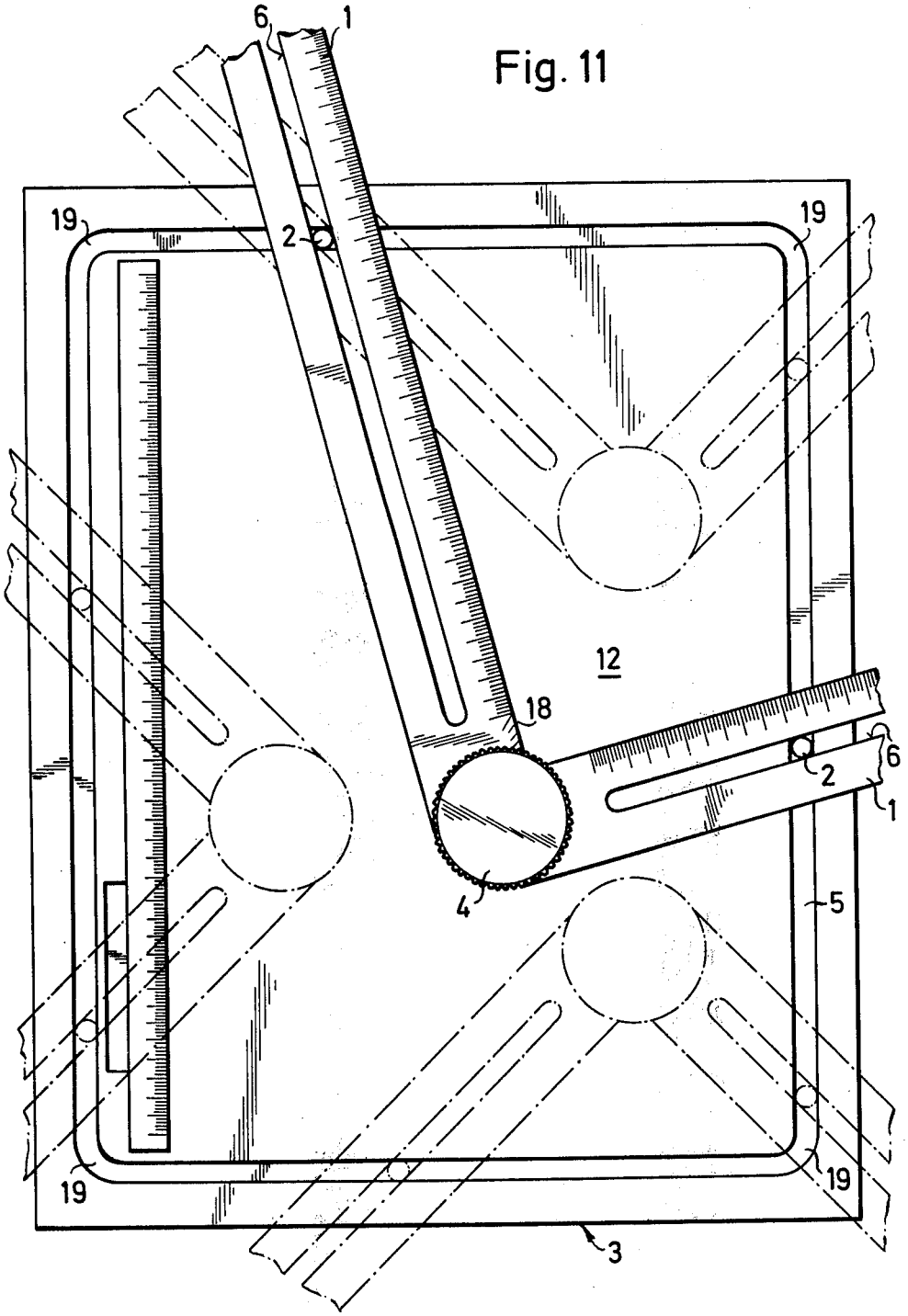
FIG. 11 is a plan view of a drawing frame comprising two drawing instruments set perpendicularly to each other.

Using the clamping knob 4, the selected angular settings can be maintained by clamping action. The clamping knob 4 also serves as a handle for sliding the drawing instruments 1. Independently of the set angle, the drawing instruments 1 can be moved into any possible position on the drafting frame 3, and may be infinitely adjustable and without removal. FIG. 11 illustrates two drawing instruments set perpendicularly to each other. Between the two drawing instruments there is an arrestor device as already described, which defines a fixed angular setting of the two instruments to each other at specific angular intervals.

Since the drawing instruments 1, including their slots 6, have four edges by contract to conventional drawing instruments, these edges can be engraved with different scales.

Instead of the linear type drawing instruments 1 illustrated in FIGS. 1, 9 and 11, it is also possible to use set squares, protractors and any type of curves of templates in a similar manner.

With the drafting machines described, by contrast to known machines, it is possible for paper holders to be fitted on a number of sides.

Further embodiments will now be described, by which a more exact guiding of the drawing instruments both in the straight sections of the groove or along the corresponding abutment edges, and also in the curved sections can be achieved.

In FIG. 12 guide components 21 and 21' are used, connected together by a bridge 22, which can also be constructed as a protractor. The slide element 2 slides by means of the guide components 21, 21' in the groove 5 and can be moved along this groove.

A shaft 24 is integrally connected to the bridge 22 or constitutes one piece together therewith. A stop 10 (FIGS. 12, 15) is disposed about this shaft, which is rigidly connected to a disc 9 or forms one piece with this disc. The stop 10 has four projections 25, 25', 25'', 25''', which serve for guiding the appropriate drawing instrument 1, which can be slid in or contrary to the direction of an arrow 26. If it is desired to set any particular angle for the drawing instrument, then the stop 10 and with it a disc 9, which has an indicator mark 11, is turned by means of the drawing instrument 1 until the desired angular setting is indicated by the indicator mark. As in the afore-described embodiment, the angle which has been set can be fixed by means of the clamping knob 20. The stop 10 projects above the upper edge of the drawing instrument 1. Therefore, although the angular setting is fixed, the drawing instrument 1 can be moved in or contrary to the direction of the arrow 26 as desired. This moving of the instrument 1 can of course be carried out with any angular setting.

The slide element 2 described permits sliding of the drawing instrument 1 both along the straight sections of the groove 5 and also in the region of its curved portions 19.

In a further example of embodiment, slide element 2 (FIGS. 16, 17) comprises a single-part component including protractor 8, a shaft 24 and bearings 23 and 23'. The shaft 24, located in the groove 5, together with the two bearings 23, 23′, provides an exact guidance for the slide element 2 both along the straight sections and also in the region of the curved portions 19 of the groove 5.

As described in relation to FIG. 12, the stop 10 forms together with the disc 9 a single-part component, which serves for guiding the drawing instrument 1 and also for setting any desired angular position.

Figure 15:
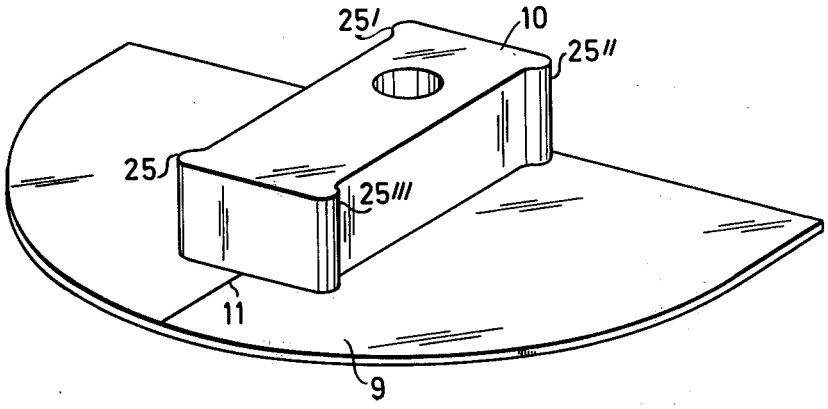
FIG. 15 is a perspective view, to an enlarged scale, of a stop for guiding the drawing instruments.
Figure 20:
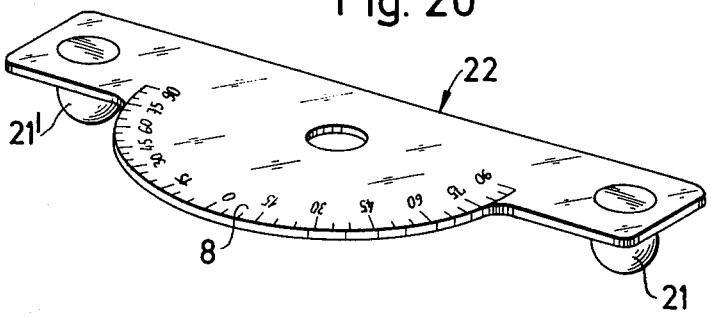
FIG. 20 is a perspective view of a bridge with a protractor according to FIG. 12.

As illustrated in relation to FIGS. 15 and 16, the surfaces of the bearings 23, 23′, 25, 25′, 25″, 25‴ are domed, in order to permit trouble free sliding.

FIGS. 18 and 19 show a further embodiment of the slide element, which consists of a single guide component 21 and a shaft 24 rigidly connected to it. The guide component 21 is so constructed that there are always four bearing positions both in the straight sections and also in the curved portions 19 of the groove 5.

The guide component 21 comprises a substantially rectangular stop 7, which serves for holding the protractor 8 accurately in its position.

As described in relation to FIG. 12, the drawing instrument 1 can, as also in the embodiment according to FIGS. 18 and 19, be slid as desired transversely to the direction of slide of the slide element 2; this displacement can be carried out in any desired angular position of the drawing instrument 1.

Figure 14:
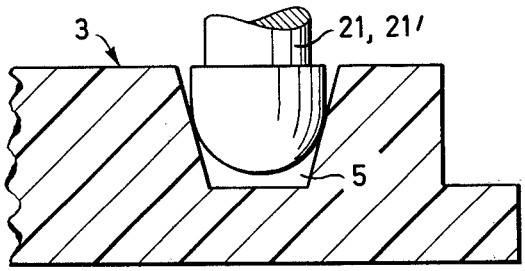
FIG. 14 is a partial section through a further example of an embodiment of a groove having inclined walls and a guide component running in the groove.

In all the embodiments described, a groove having inclined walls in accordance with FIG. 14 may be used, that is to say the inclination is so designed that the groove widens out upwardly, so that the guide components 21, 21′ can always be freely guided, in spite of certain manufacturing tolerances. In order to ensure that the guide components 21, 21′ fit against the walls of the groove 5, the region of these guide components 21, 21′ which bears against the walls is of domed shape (FIG. 14).

As in known drafting appliances, it is possible with all the slide elements according to this invention, to provide fixing devices for the slide elements and for the drawing instruments.

Instead of the groove 5 as described or the abutment edge referred to for guiding the slide elements 2, a web or rib, itself of known type, can be used. In this case it is only necessary to reverse the guide components 21, 21′ in their shape, so that they can grip around this rib or web. In this case it is to be recommended that the surfaces of the guide components which bear against the external walls of the rib are domed in a similar manner to the bearing surfaces 23, 23′ shown in FIG. 16.

Figure 21:
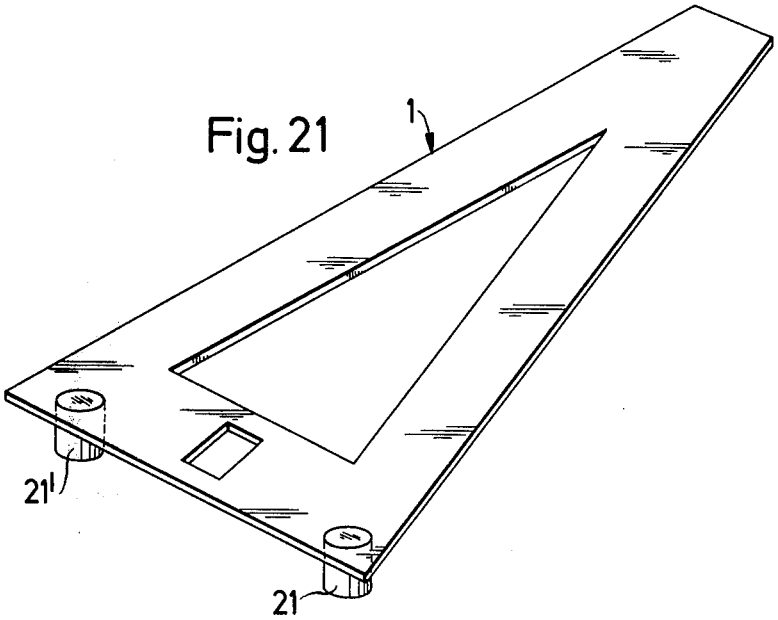
FIG. 21 is a perspective view of another drawing instrument with rigidly mounted guide components.

According to FIG. 21, it is also possible for other drawing instruments 1, for example drawing triangles or set squares, to be used having guide components 21, 21′ rigidly fixed to them as slide elements, the drawing instrument 1 and guide components 21, 21′ being formed as one piece. It is also possible to slide the drawing instruments shown in FIG. 1 along the entire groove, including the rounded regions 19, without it being necessary to remove and reinsert them.

The slide elements can be secured against disengagement by having the groove tapering upwardly, with the edges of the groove lapping over the slide elements; it is also possible to use a magnetic rod, which attracts the metal-containing slide elements, as already described.

Instead of the slot 6 formed in the drawing instrument 1, it is also possible to use merely a recess, which is so dimensioned as just to correspond to the external dimensions of the stop 10; in this manner, the drawing instrument 1 can be pushed on to the stop 10 and can be rotated with it at any time as desired during drawing, upon the slide element 2.

What I claim is:

1. A drafting machine, comprising a rectangular drafting frame, a continuous and uninterrupted guide groove provided on a drawing surface of said frame and having portions parallel to each side edge thereof, said groove having smooth outer and inner side walls and making a smooth transition at corners of said frame by having smooth rounded corners thereat, a pair of spaced apart slide elements disposed in said groove, bridge means interconnecting said slide elements, at least one drawing instrument being connected to said bridge means, and said slide elements each having a rounded surface facing inwardly of said frame, whereby said instrument may be displaced longitudinally of said guide groove in a rectilinear movement along said portions thereof, and whereby said instrument pivots about a central axis of said bridge means located between said slide elements upon movement of said instrument along said rounded corners.

2. The machine according to claim 1, wherein said drawing instrument has a single elongated slot defining four edges together with the side edges of said drawing instrument, graduated scales being disposed on each of said edges.

3. A drafting machine, comprising a rectangular drafting frame, a continuous and uninterrupted guide groove provided on a drawing surface of said frame and having portions parallel to each side edge thereof, said groove having smooth outer and inner side walls and making a smooth transition at corners of said frame by having smooth rounded corners thereat, at least one slide element disposed in said groove, said slide element having a flat plane surface and an opposite domed surface respectively in smooth contacting engagement with said outer and said inner walls of said groove, at least one drawing instrument being connected to said slide element, whereby said instrument may be displaced longitudinally of said guide groove in a rectilinear movement along said portions thereof, and whereby said instrument pivots about a central axis of said slide element upon movement of said instrument along said rounded corners.

4. The machine according to claim 3, wherein a protractor having an annular scale thereon is rotatably mounted on said slide element.

5. The machine according to claim 4, wherein a circular disc is rotatably mounted on said slide element, said disc having an indicator mark and further having a stop element thereon over which said drawing instrument extends for guiding same relative to said groove.

6. The machine according to claim 5, wherein an arrestor device is provided between said disc and said protractor for retaining said disc in a fixed angular position relative to said protractor.

7. The machine according to claim 5, wherein said stop element has at least two bearing surfaces thereon.

8. The machine according to claim 4, wherein said drawing surface has a depression thereon parallel to said groove, said depression having opposite flat sidewalls, and said protractor being disposed within said depression and having opposite flat sidewalls for guiding said protractor along said depression side walls.

9. The machine according to claim 3, wherein a knob is provided for connecting said drawing instrument to said slide element, said drawing instrument being slideable relative to said slide element.

10. A drafting machine, comprising a rectangular drafting frame, a continuous and uninterrupted guide groove provided on a drawing surface of said frame along each side edge thereof, a slide element slideably disposed in said groove, a drawing instrument pivotably connected to said slide element, a disc rotatably mounted on said slide element, said disc having a stop element thereon, and said drawing instrument having an opening therein snugly embracing said stop element, whereby said drawing instrument may be slid longitudinally of said groove and rotated angularly relative thereto.

11. A drafting machine, comprising a rectangular drafting frame, a continuous and uninterrupted guide groove provided on a drawing surface of said frame and having portions parallel to each side edge thereof, said groove having smooth outer and inner side walls and making a smooth transition at corners of said frame by having smooth rounded corners thereat, at least one slide element disposed in said groove, said slide element being elongated and bearing against said side walls of said groove at spaced bearing points on said slide element, at least one drawing instrument being connected to said slide element, and said slide element having a rounded surface facing inwardly of said frame, whereby said instrument may be displaced longitudinally of said guide groove in a rectilinear movement along said portions thereof, and whereby said instrument pivots about a central axis of said slide element upon movement of said instrument along said rounded corners.

12. A drafting machine, comprising a rectangular drafting frame, a continuous and uninterrupted guide groove provided on a drawing surface of said frame and having portions parallel to each side edge thereof, said groove having smooth outer and inner side walls and making a smooth transition at corners of said frame by having smooth rounded corners thereat, at least one slide element of magnetic material being disposed in said groove, and a magnetized rod being disposed within said groove for attracting said slide element and retaining it within said groove, at least one drawing instrument being connected to said slide element, and said slide element having a rounded surface facing inwardly of said frame, whereby said instrument may be displaced longitudinally of said guide groove in a rectilinear movement along said portions thereof, and whereby said instrument pivots about a central axis of said slide element upon movement of said instrument along said rounded corners.

13. A drafting machine, comprising a rectangular drafting frame, a continuous and uninterrupted guide groove provided on a drawing surface of said frame and having portions parallel to each side edge thereof, said groove having smooth outer and inner side walls and making a smooth transition at corners of said frame by having smooth rounded corners thereat, at least one slide element disposed in said groove, at least one drawing instrument being connected to said slide element, a protractor being fixedly mounted over said slide element by means of bearings engaging a side edge of said drafting frame, and said slide element having a rounded surface facing inwardly of said frame, whereby said instrument may be displaced longitudinally of said guide groove in a rectilinear movement along said portions thereof, and whereby said instrument pivots about a central axis of said slide element upon movement of said instrument along said rounded corners.

* * * * *